US005153415A

United States Patent [19]

Samejima et al.

[11] Patent Number: 5,153,415

[45] Date of Patent: Oct. 6, 1992

[54] COUNTER FOR ELASTIC RINGS

[75] Inventors: Hisashi Samejima; Fumiya Yamamoto, both of Kobe, Japan

[73] Assignee: Bando Kagaku Kabushiki Kaisha, Japan

[21] Appl. No.: 517,223

[22] Filed: May 6, 1990

[30] Foreign Application Priority Data

May 10, 1989 [JP] Japan ..... 1-117898

[51] Int. Cl.[5] ..... G06M 1/00

[52] U.S. Cl. ..... 235/98 C; 221/75

[58] Field of Search ..... 235/98 C, 98 R, 98 A, 235/98 B; 221/75, 296, 312 A

[56] References Cited

U.S. PATENT DOCUMENTS 4,677,283 1/1987 Lewis ..... 235/98 C 4,995,531 2/1991 Summers ..... 221/75

FOREIGN PATENT DOCUMENTS 755512 8/1980 U.S.S.R. ..... 221/75

*Primary Examiner*—L. T. Hix

*Assistant Examiner*—Eddie C. Lee

*Attorney, Agent, or Firm*—Marshall, O'Toole, Gerstein, Murray & Bicknell

[57] ABSTRACT

This disclosure relates to a counter for elastic rings, comprising a screw having a spiral groove which is slightly wider than the width of an elastic ring and is slightly deeper than the thickness of the elastic ring. The screw has an open discharge end, and a plurality of sorting rollers are loosely mounted in series on a support shaft located above and parallel to the screw and are independently capable of rotation and vertical movement. The sorting rollers contact a spiral ridge of the screw, and are arranged such that while the screw is rotated and the elastic rings are fed to the feed end thereof, the elastic rings are loosely moved into the spiral groove of the screw by the sorting rollers, and then sequentially delivered from the discharge end of the screw to a counting means.

3 Claims, 3 Drawing Sheets

COUNTER FOR ELASTIC RINGS

FIELD AND BACKGROUND OF THE INVENTION

The present invention relates to apparatus for counting the number of elastic rings such as belts, rubber bands and O-rings.

In the past, in a production line for making belts, for instance, the final steps of counting the number of belts, bundling a specified number of belts together, and packing the bundle were mostly made manually by workers. In particular, counting of the belts was made by workers by actually counting them one by one.

For O-rings, one of the aforementioned types of elastic rings, apparatus has been proposed which automatically aligns a random number of O-rings in a pile and feeds them one at a time to a counter. Hence use of such a feeder may allow relatively easy and accurate counting of O-rings and the like.

Feeders of the above kind are of two types: a single spindle system wherein O-rings are aligned by sequentially guiding them into a spiral groove on a single screw, and a two spindle system wherein O-rings are aligned by running the O-rings over two screws.

One example of the single spindle type O-ring feeder is the apparatus described in Japanese Patent Publication No. SHO56-48412. This apparatus comprises a main screw onto which O-rings are loosely inserted, a plurality of driving screws which rotatably support the main screw and transmit turning force to the main screw, and a claw which slidably contacts the spiral ridge on one side of the main screw to drop an O-ring into the spiral groove. The apparatus is arranged to rotate the main screw, sequentially drop O-rings fed to one side (the claw side) of the main screw into the spiral groove, and deliver the O-rings to the other end of the main screw.

One example of the two spindle type O-ring feeder is the apparatus described in Japanese Provisional Publication No. SHO60-15314. The apparatus is provided with two spaced and rotatably mounted screws each having a spiral groove in the top end portion, and a shifting means for moving one screw towards the other screw. The apparatus is arranged to run a large number of O-rings around the non-spiral-groove portions of both screws, rotate one screw, align the O-rings, sequentially drop the O-rings into the spiral grooves, and deliver the O-rings from the top end.

The aforementioned conventional counting operation of belts by workers, however, is time-consuming and prone to miscounting. Furthermore, it hinders automatization of the production line for labor saving objectives and is a bottleneck in cost reduction efforts.

On the other hand, when the aforementioned single spindle type O-ring feeder is used to feed belts having a size greater than O-rings, the belts will interfere with the driving screws for the main screw and prevent feeding. Moreover, because the claw is fixed, a belt may be caught and damaged between the claw and the spiral ridge of the main screw. In particular, when belts are fed into the apparatus in a condition where they cross or overlap one another, it is almost impossible for the claw to drop belts properly into the spiral groove. Furthermore, there are problems due to a complex driving mechanism of the main screw and a high production cost.

The aforementioned two spindle type O-ring feeder may be used to feed belts. However, since the distance between the two screws is fixed beforehand, the apparatus is not capable of feeding belts of different sizes. Moreover, the minimum distance between the screws is structurally limited, and therefore the apparatus may not be used for belts of smaller sizes. Furthermore, because belts or the like are set around the two screws, setting by a worker is not easy, and belts will eventually remain between parallel grooves of the screws, requiring the worker to remove the belts.

The present invention has as its general object to avoid the aforementioned problems, and is intended to provide a counter for elastic rings which automatically and accurately counts elastic rings such as belts, and contributes to labor saving and cost reduction of products, is simple in structure, and counts elastic rings of different sizes.

SUMMARY OF THE INVENTION

To accomplish the aforementioned objectives, a counter according to the present invention comprises a screw having a spiral groove which is a little wider than the width of an elastic ring to be counted, such as a belt, and is a little deeper than the thickness of the elastic ring, the screw having an open discharge end. A plurality of sorting rollers are loosely mounted in series on a support shaft located above and parallel to the screw and are independently capable of rotational and vertical movement, the sorting rollers normally contacting the spiral ridge of the screw. When the screw is rotated, the elastic rings are placed at the feed end thereof, and the elastic rings are moved one-by-one into the spiral groove of the screw by the sorting rollers. Thus the rings are sequentially delivered from the feed end of the screw to the discharge end, and the number of the elastic rings is detected adjacent the discharge end by a counting means.

In the counter according to the present invention having the aforementioned configuration, while the screw is turning in a specific direction (the direction for moving the spiral groove towards the discharge end), elastic rings are placed onto the feed end of the screw. In the process, some elastic rings will move into the spiral groove of the screw. At this time, the sorting rollers contacting the screw rotate in the opposite direction (as viewed from an end of the screw) as the screw rotates. Some of the elastic rings may become caught on the spiral ridge or may cross or overlap with each other and do not drop into the spiral groove, and they will be contacted by a vertical wall of the first sorting roller and be moved into the spiral groove. If an elastic ring does not move into the spiral groove even when the ring contacts a sorting roller, the sorting roller will be pushed by the elastic ring, allowing the elastic ring to pass by to the discharge end of the screw. At this time, the elastic ring will contact the bottom of a sorting roller and receive a force which is in the screw spiral feed direction or in the opposite direction thereof. As a result, entangled elastic rings will be separated from each other, and elastic rings on the spiral ridge will be moved into the spiral groove. The sorting action of the sorting rollers is produced by each roller, from the first (feed end side) roller to the last one (discharge end side), and all of the elastic rings will be eventually moved into the spiral groove of the screw. Once the rings are moved into the spiral groove, the bottom surfaces of the sorting rollers contact the spiral ridge to close the upper opening of the spriral groove and prevent the elastic rings from moving out of the spiral groove. As a result, the elastic rings are individually held in the spiral groove of the screw and moved forwardly as the screw is turned, and then the rings are sequentially delivered out of the discharge end of the screw. Thus the number of the elastic rings can be easily and accurately counted by a counting means.

The feed end of the screw may also be extended to form a loading spindle for loading elastic rings and to support an elastic ring loading sleeve. The loading spindle and the screw are loosely inserted through the sleeve which provides a feeding mechanism for delivering elastic rings placed on the loading sleeve to the screw along the loading spindle. Means for collecting elastic rings is mounted adjacent the discharge end of the screw, and means for counting elastic rings is provided near the point where the collecting means and the screw are connected with each other.

With the use of the above apparatus, feeding a large number of elastic rings can be accomplished very easily by means of the loading sleeve. As the loading sleeve does not turn even when the screw is rotated, the elastic rings placed on the loading sleeve do not tangle with each other, and thus the elastic rings are smoothly fed to the feed end side of the screw by the feeding mechanism. Then the elastic rings are sequentially delivered from the discharge end of the screw by the aforementioned action of the sorting rollers and the screw. The elastic rings thus delivered are collected by the collecting means, and when each elastic ring is delivered from the screw, it is automatically counted by the counting means.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
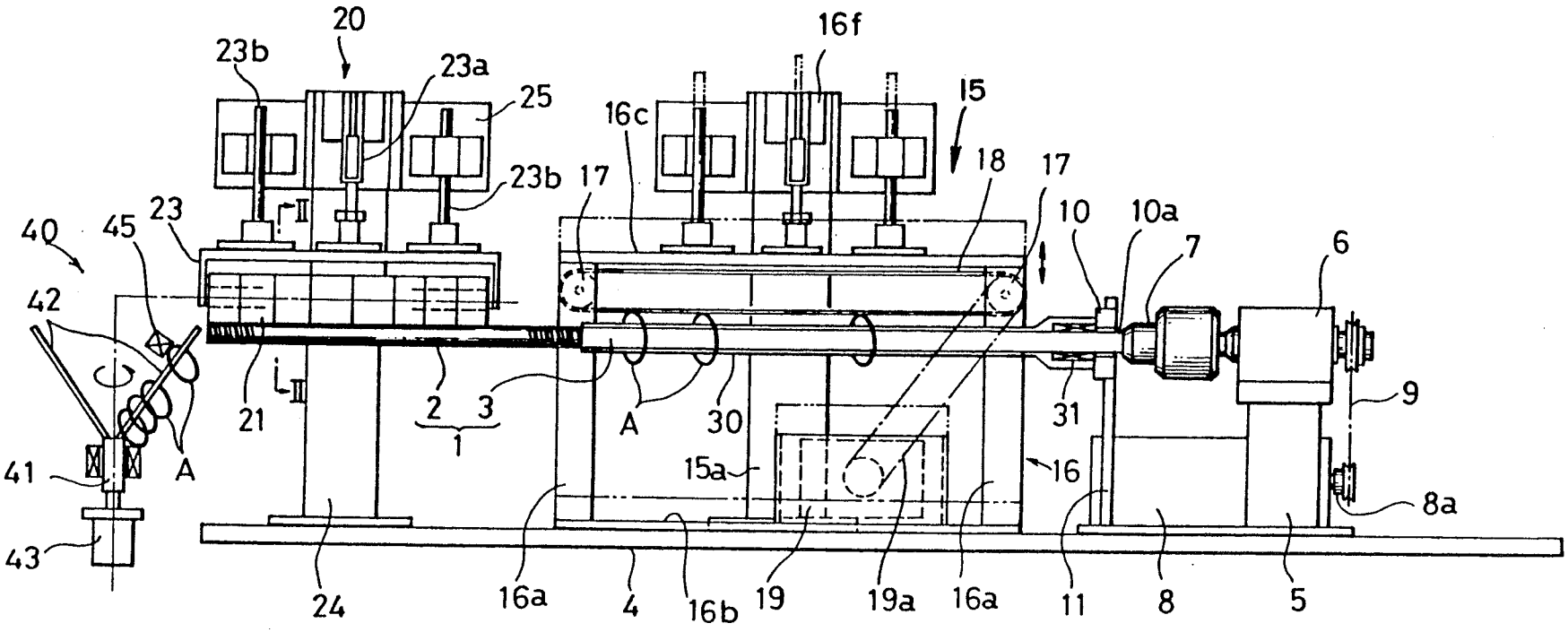
FIG. 1 is an elevational view partly in section showing the overall arrangement of an embodiment of a belt counter according to the present invention.

By way of example, the embodiment of the counter shown in the drawings is described in connection with a belt counter but it could instead be used for other types of rings.

In FIG. 1, a shaft 1 is formed by a screw 2 having a spiral groove 2*a* (FIG. 4) formed therein, on the discharge end of the shaft 1, and a mounting spindle 3 in the form of a round rod, on the feed end of the shaft. The screw and the mounting spindle are in this example integrally connected with each other. On one end (the right-hand side of the drawing) of a support base 4, a support stand 5 is provided. A speed reducing mechanism 6 is fixed on the top of the support stand 5, and a chuck 7 is mounted on one end of the speed reducing mechanism 6. The feed end which is the mounting spindle of the shaft 1 is disconnectably cantilevered by the chuck 7. The other end of the speed reducing mechanism 6 is connected to a drive shaft 8*a* of a drive motor 8 mounted on the support base 4 beneath the speed reducing mechanism 6, by means of a transmission belt or chain 9 and spindles; the shaft 1 is thus rotated by the drive motor 8.

Closely adjacent to the discharge end of the chuck 7, a magnet ring 10 for holding one end of a loading sleeve 30 to be described later is installed on the upper end portion of a support member 11 erected on the support base 4. A central opening or port 10*a* of the magnet ring 10 is wide enough to pass the shaft 1.

With the shaft 1 mounted in the chuck 7, a belt feeding mechanism 15 is provided above the shaft 1, from the discharge end to the feed end of the loading spindle 3, in a vertically movable manner relative to a central support pillar 15*a* erected on the support base 4. The belt feeding mechanism 15, according to the present embodiment, comprises a rectangular frame 16, a pair of pulleys 17 rotatably supported by the vertical frame members 16*a* on both sides of the frame 16, a transfer belt 18 running around the pair of pulleys 17 and generally parallel to the shaft 1, and one or more hooks 18*a* fixed on said transfer belt 18 at appropriate points. One of the pulleys 17 is turned by a drive 19 via a transmission belt or chain 19*a*, the drive 19 being installed on the horizontal frame members 16*b* connected to the lower ends of the frame members 16*a*, to rotate the belt 18 in the clockwise direction as seen in FIG. 1. From the horizontal frame members 16*c* at the top of the frame 16, a support rod 16*d* and guide rods 16*e* on both sides thereof are extended upwardly, and the support rod 16*d* is moved vertically by a toggle means 16*f* mounted on the top end of the support pillar 15*a* to raise and lower the feeding mechanism 15. In place of the toggle means 16*f*, a hydraulic cylinder such as air cylinder may be employed to raise and lower the feeder 15.

The width of the spiral groove 2*a* of the screw 2 is set a little wider than that of a belt A, and the depth of the spiral groove 2*a* is set a little larger than the thickness of the belt A. In other words, the sizing is such that a single belt A can drop into any one portion of the spiral groove 2*a*, but two belts A cannot.

Figure 2:
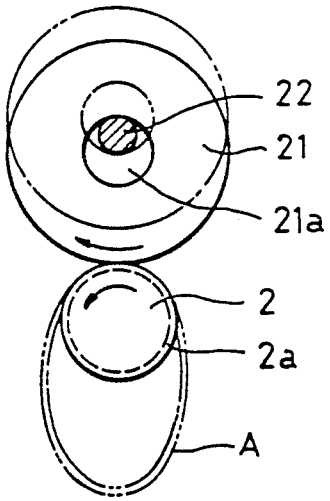
FIG. 2 is an enlarged sectional view taken along the line II—II of FIG. 1.

Above the screw 2 is provided a sorting mechanism 20 for the belts A. This sorting mechanism 20 comprises, as shown in FIG. 2, a plurality of (eight in the present specific example) wheel-like parallel sorting rollers 21 each having a flat outer circumference and a large bore 21*a* in the center thereof, the bore being greater (for example, 20 mm in diameter) than a support shaft 22, and the support shaft 22 (for example, 10 mm in diameter) being arranged in parallel with the screw 2 and passing through the central bore 21*a* of each sorting roller 21 in such a way that the rollers contact each other while being vertically movable individually. With this arrangement, the sorting rollers 21 are supported so that the rollers 21 are able to individually move in vertical direction and rotate relative to the support shaft 22. The width of each sorting roller 21 is made larger than the width of the spiral groove 2*a* of said screw 2 to prevent the sorting rollers 21 from dropping into the spiral groove 2*a*. Both ends of the support shaft 22 are fixed on a support frame 23 having an open bottom, and a support bar or bars 23*a* (one shown in the example) and a guide bar or bars 23*b* (two shown in the example) extend from the support frame 23. The support bar or bars 23*a* is moved vertically together with the guide bar or bars 23*b* by means of a toggle clamp mechanism 25 on the top of a support pillar 24 erected on the support base 4 so that the sorting rollers 21 are held and allowed to contact the spiral ridge 2*b* of the screw 2 and vertically move within a certain limit range relative to the screw 2. The toggle means 16*f* and toggle clamp mechanism 25 are known types of servo units that are constructed to convert rotation of a crank into a vertical movement by transmitting the rotation via a connecting link to a toggle link.

A loading sleeve 30 (FIGS. 1 and FIGS. 3*a* to 3*c*) is designed for setting belts A to be counted on the loading spindle 3 and is mounted over the spindle 3, and the inner diameter of the loading sleeve 30 is made a little larger than the shaft 1. One end (on the right-hand side of the diagram) of the loading sleeve 30 is expanded in diameter, and a bearing member 31 is placed in the internal circumference of the loading sleeve 30 so that the loading sleeve 30 slides smoothly on the spindle 3 when the loading sleeve 30 is placed over the shaft 1 (screw 2) from the discharge end thereof and shifted to the feed end (loading spindle 3). The loading sleeve 30 or at least the feed end thereof is formed of a material that is attracted and held by the magnet ring 10. The hooks 18*a* of the belt feeding mechanism 15 contact the loading sleeve 30 mounted on the loading spindle 3 when the feeding mechanism is lowered.

A collecting means 40 for the belts A is provided near the discharge end of the screw 2. The collecting means 40 comprises a plurality of collecting rods or bars 42 that extend upwardly and radially outwardly at regular intervals from the top of a vertical rotary shaft 41. The lower end of the rotary shaft 41 is coupled to a driver 43, and the rotary shaft 41 is intermittently rotated through a given angle so that the top end of each collecting bar 42 stops in a position at which the top end is located at the top end of the screw 2.

Near the upper end of the collecting bar 42 which is adjacent the discharge end of the screw 2, a counting device such as a photosensor 45 having an integrating mechanism is mounted to detect the belts A moving (dropping) along the collecting bar 42. The sensor 45 is connected to the controllers (not illustrated) of the drivers 8, 19 and 43 of the shaft 1, the feeding mechanism 15 and the collecting means 40, respectively. The sensor 45 counts the number of belts A, and when the count reaches a preset number, the drivers 8 and 19 of the shaft 1 and the feeding mechanism 15 are stopped simultaneously, and then the driver 43 of the collecting bars 42 is rotated by a certain angle to connect the next empty collecting bar 42 to the discharge end of the screw 2. The belts A may be manually removed from the bars 42 which are displaced from the screw 2.

The operation of the belt counter described above is as follows.

First, with reference to FIG. 1, assume that the sorting mechanism 20 and the belt feeding mechanism 15 are shifted upwardly to their respective positions (not illustrated) where they are spaced above the shaft 1 to provide clearance above the shaft 1 for a jig 50.

Figure 3A:
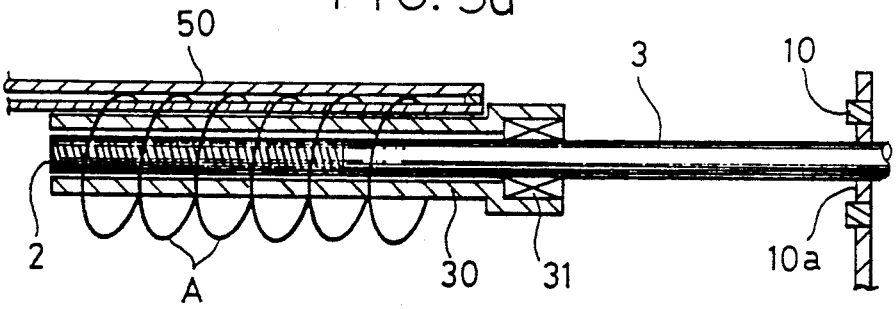
FIGS. 3*a* to 3*c* are schematic sectional views of the shaft portion, illustrating the belt loading procedure.
Figure 3B:
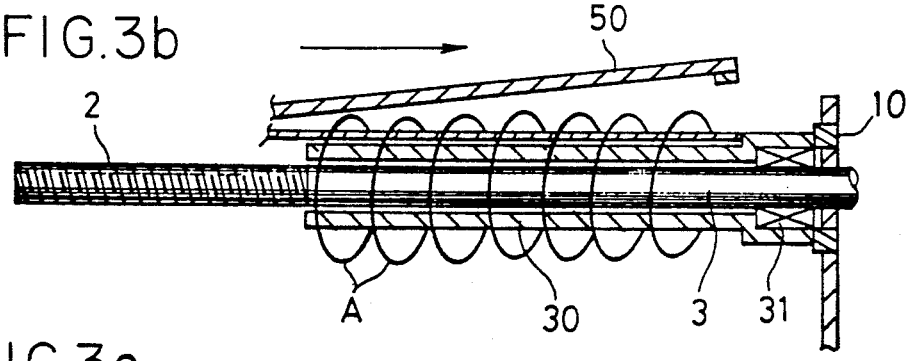
Figure 3C:
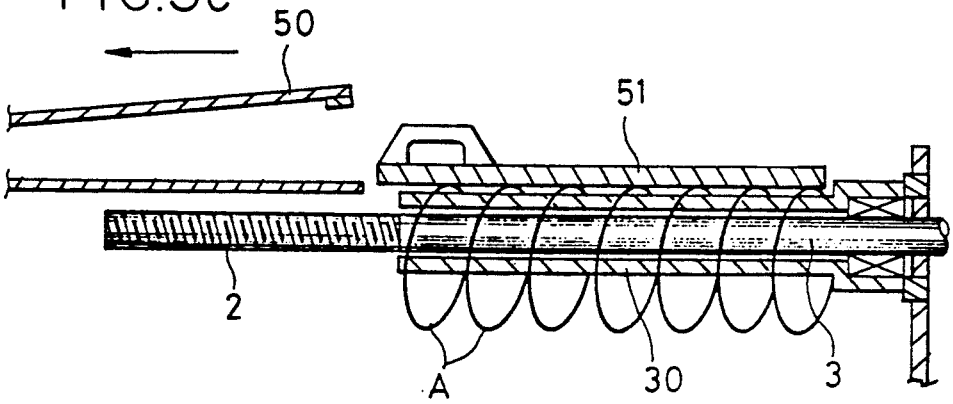

Next, the loading sleeve 30 is moved towards the discharge end of the shaft 1 by pulling the sleeve away from the magnets 10. As shown in FIG. 3*a*, belts A are loosely placed on the loading sleeve 30 by manually holding a large number of belts A with, for example, a belt clamping jig 50. Together with the belt clamping jig 50, the loading sleeve 30 is slid from the discharge end of the shaft 1, along the shaft 1 toward the right, to the loading spindle 3 on the feed end side (FIG. 3*b*). When the feed end of the loading sleeve 30 contacts the magnet ring 10 (FIG. 3*b*), the loading sleeve 30 is attracted by the magnet ring 10 and the loading sleeve 30 will be fastened on the loading spindle 3. At this point, the belt clamping jig 50 is opened as shown in FIG. 3*b*, and the belt clamping jig 50 is withdrawn toward the left from the loading sleeve 30 while the belts A are held by, for example, a belt clamping plate 51 (FIG. 3*c*). In this way, a large number of belts A are loaded over the loading sleeve 30. The loading sleeve 30 is held in a non-turning state by the magnets such that the loading sleeve 30 does not rotate with other parts even when the shaft 1 rotates.

The sorting mechanism 20 and the belt feeding mechanism 15 that had previously been raised upwardly are then lowered onto the shaft 1 to the position shown in FIG. 1. At this position, the range of vertical movement of the sorting rollers 21 on the support shaft 22 (FIG. 2) is set by the size of the hole 21*a* relative to the shaft 22 to be between the state where the bottoms of the sorting rollers 21 are just in contact with the spiral ridge 2*b* of the screw 2 and to a raised height of normally about three times the thickness of the belt A, and the sorting mechanism 20 is then secured by the clamp mechanism 25. The feeding mechanism 15 is set in a state wherein the hook (or hooks) 18*a* of the transfer belt 18 is located at the feed end of the loading sleeve 30 and is ready to move horizontally parallel with the loading sleeve 30 towards the discharge end.

The aforementioned preparatory operation is mainly carried out by an operator. When the preparatory operation is completed, the belts A will be automatically counted when the start switch (not illustrated) is pressed. When the drive motors are started:

(1) The transfer belt 18 of the feeding mechanism 15 starts to turn clockwise, and the hook 18*a* moves the group of belts A on the loading sleeve 30 towards the screw 2 and sequentially feeds the belts A to the right-hand end of the screw 2.

(2) At the same time, the shaft 1 (including the screw 2) rotates to move the belts A fed to the screw 2 towards the discharge end thereof. Of the belts A fed to the screw 2, some belts A drop into the spiral groove 2*a*, and the rest do not.

(3) Belts A that do not drop into the spiral groove 2*a* in the step (2) above are guided into the spiral groove 2*a* by the sorting rollers 21 as illustrated in FIGS. 4*a* to 4*e*. Eventually all of the belts A are placed in the spiral groove 2*a* and fed to the discharge end of the screw 2.

(4) The belts A are sequentially delivered as the screw 2 is turned.

(5) The delivered belts A drop downwardly along a collecting bar 42 that is adjacent the top end of the screw 2 and accumulate on the lower portion of the collecting bar 42. When each belt A descends along the collecting bar 42, the sensor 45 detects the passing of a belt A and counts the number of belts A.

(6) When the sensor 45 counts up a preset number of belts A, it actuates the controllers to stop the movement of the screw 2 and the transfer belt 18.

(7) Next, the rotary shaft 41 is turned by a specified angle to connect the next collecting bar 42 to the top end of the screw 2.

The operations of the aforementioned steps (1) to (7) are then repeated, and when a desired number of belts A are collected on each collecting bar 42, the operator will turn off the switch, and then the operator may take away from one collecting bar 42 at a time to bind and pack belts A.

Now the action of the sorting rollers 21 in the step (3) above will be described in further detail.

The diagrams of FIG. 4 show that the screw 2 turns counterclockwise when viewed from the feed end side (the right-hand side of FIG. 1) to move the belts A towards the discharge end thereof.

Figure 4A:
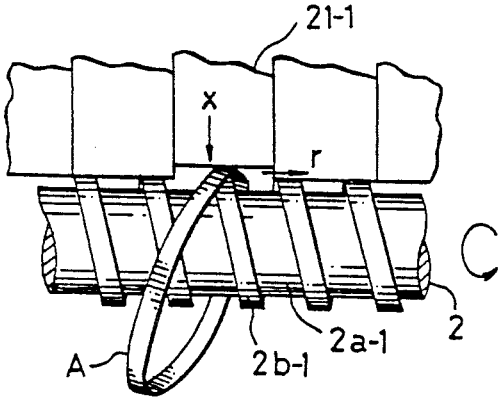
FIGS. 4*a* to 4*e* are enlarged fragmentary front views of the screw and sorting rollers, illustrating the action of the sorting rollers for various orientations of the belts on the screw.

In FIG. 4*a*, a belt A is caught on a spiral ridge 2*b*-1 at a point indicated by an arrow x, and a sorting roller 21-1 contacts the belt A. Under this condition, a force acts on the belt A in the direction of the feed end of the screw 2 (see the arrow r) and the belt A will drop into the spiral groove 2*a*-1 on the right-hand side of the sprial groove 2*b*-1.

Figure 4B:
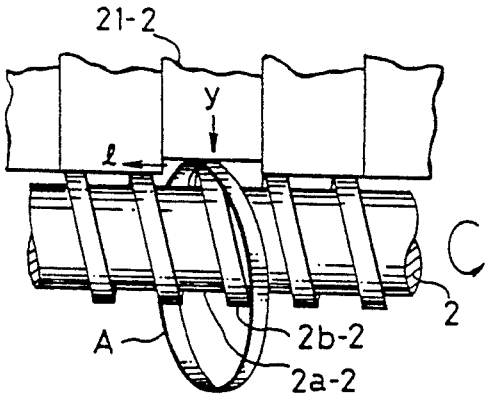

In FIG. 4*b*, a belt A is caught on a spiral ridge 2*b*-2 at a point indicated by a downward arrow y, and a sorting roller 21-2 contacts the belt A. Under this condition, a force acts on the belt A in the direction towards the discharge end of the screw 2 (arrow e) and the belt A will drop into a spiral groove 2*a*-2 on the left-hand side of the spiral groove 2*b*-2.

Figure 4C:
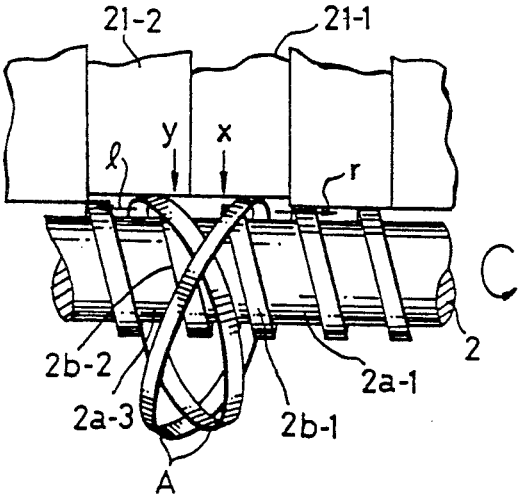

In FIG. 4*c*, a belt A is caught on the spiral ridge 2*b*-1 at a point indicated by an arrow x, and another belt A is caught on the spiral ridge 2*b*-2 at a point indicated by an arrow y, respectively, and the two belts are entangled together and cross each other. The sorting roller 21-1 is in contact with the right-hand belt A, and the sorting roller 21-2 is in contact with the left-hand belt A. Under this condition, a force in the direction of the arrow r works on the right-hand belt A, and a force in the direction of the arrow l works on the left-hand belt A because of the same reasons as explained above. As a result, the right-hand and left-hand belts A will be disentangled from each other, and the right-hand belt A will drop into the spiral groove 2*a*-1 on the right-hand side of the spiral ridge 2*b*-1, and the left-hand belt A will drop into the spiral groove 2*a*-3 on the left-hand side of the spiral ridge 2*b*-2.

Figure 4D:
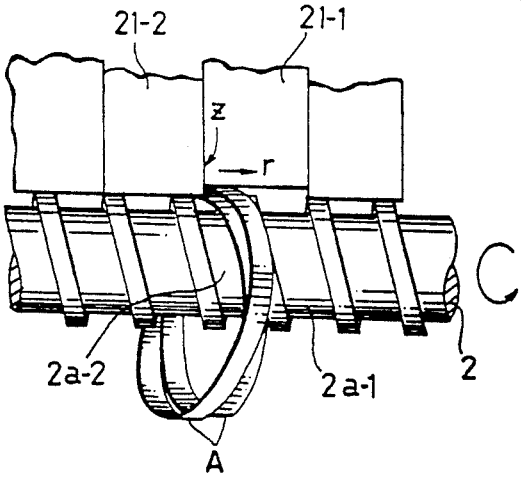

In FIG. 4*d*, of the two overlapping belts A, the inner belt A is in the spiral groove 2*a*-2. The outer belt A is against the sorting roller 21-1, and the outer belt A confronts a vertical face (arrow z) of the sorting roller 21-2 on the left-hand side and receives a force in the direction of the arrow r. As a result, the outer belt A will be separated from the inner belt A. Then the outer belt A will drop into the spiral groove 2i a-1.

Figure 4E:
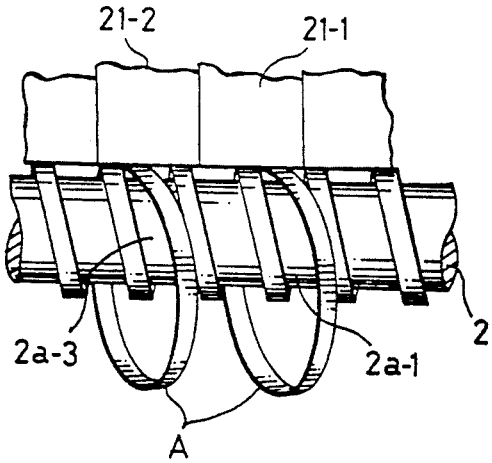

FIG. 4*e* illustrates the state of belts A being moved towards the discharge end in the spiral grooves 2*a*-1 and 2*a*-3. The upper openings of the spiral grooves 2*a*-1 and 2*a*-3 are closed by the sorting rollers 21-1 and 21-2, respectively, to prevent belts A from escaping.

In the aforementioned embodiment, a certain number of belts A are sequentially collected on a plurality of radial collecting bars 42. Other arrangements, however, may be used. For example, belts delivered from the discharge end of the screw 2 may be collected on a belt conveyor to sequentially transfer the belts to a desired location.

When a group of belts wherein the width and thickness differ from those of the belts A of the above-mentioned embodiment are to be counted, the screw may be replaced with one that has a spiral groove sized to the belts to be counted. Furthermore, to enable an adjustment of the feeding rate of the belts A to the screw spiral, the speed of the driver of the belt feeding mechanism may be controlled to effect various operations such as constant speed, intermittent, and variable speed operations.

When the width and thickness of belts A are identical to those of a group of belts of a different size (diameter), the counter is applicable without any modification. The counter according to the present invention is applicable to counting of O-rings and rubber bands as well as belts.

As is clear from the aforementioned description, the counter for elastic rings according to the present invention has the following effects:

(1) The counter is capable of automatically and accurately counting elastic rings such as belts, and contributing to labor saving and cost reduction of products, is simple in structure, and is capable of counting elastic rings of different sizes. Furthermore, as the elastic rings are sequentially delivered in order and counted, the operation of binding and packing the elastic rings after collection can be made with ease.

(2) With the use of the counter, loading of a large number of elastic rings on the counter can be made very easily and it is convenient. Since the loading sleeve is held against turning even when the screw is rotated, the elastic rings will not tangle with each other. Thus the elastic rings are smoothly fed to the feed end of the screw by the feeding mechanism. The elastic rings are sequentially delivered from the discharge end of the screw and then automatically collected by the collecting means. At the same time, the number of the elastic rings delivered is automatically counted by the counting means; thus the workload of the operator is reduced significantly, and the operation efficiency is improved drastically.

What is claimed is:

1. A counter for annular elastic rings having an axially directed width and a radially directed thickness, comprising a screw having a spiral outer ridge surface and having a spiral groove which is slightly wider than said width of an elastic ring and is slightly deeper than said thickness of the elastic ring, said screw further having a feed end and an open discharge end, and a plurality of sorting rollers which are loosely mounted in series on a support shaft located above and parallel to said screw, said rollers being independently movable rotationally and vertically relative to said screw, said sorting rollers having flat outer surfaces normally contacting said spiral outer ridge surface and bridging said groove of said screw during operation, wherein while said screw is rotated, said elastic rings are fed to said feed end thereof, and the elastic rings are loosely placed into said spiral groove of the screw by said sorting rollers one by one, and then sequentially delivered from said discharge end of the screw.

2. A counter for elastic rings as set forth in claim 1, wherein said feed end of said screw is extended to form a loading spindle for loading elastic rings, an elastic ring loading sleeve, into which said loading spindle and said screw are loosely inserted, is disconnectably held against rotation, around said loading spindle, and a feeding mechanism, for moving elastic rings loaded on said loading sleeve to said screw, is provided adjacent said loading spindle.

3. A counter for elastic rings as set forth in claim 1, and further including collecting means adjacent said discharge end of said screw for receiving rings from said screw, and detector means adjacent said collecting means for counting the rings.

* * * * *